US007634214B2

(12) United States Patent
Sekiyama et al.

(10) Patent No.: US 7,634,214 B2
(45) Date of Patent: Dec. 15, 2009

(54) SHEET CONVEYANCE APPARATUS, SHEET PROCESSING APPARATUS, AND IMAGE FORMING APPARATUS

(75) Inventors: Junichi Sekiyama, Tokyo (JP); Masayoshi Fukatsu, Suntoh-gun (JP); Atsushi Ogata, Mishima (JP); Hiroharu Tsuji, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 84 days.

(21) Appl. No.: 11/691,809

(22) Filed: Mar. 27, 2007

(65) Prior Publication Data

US 2007/0228646 A1 Oct. 4, 2007

(30) Foreign Application Priority Data

Mar. 31, 2006 (JP) ..... 2006-096437
Mar. 9, 2007 (JP) ..... 2007-061015

(51) Int. Cl.
*G03G 21/00* (2006.01)

(52) U.S. Cl. ..... 399/124; 399/405; 399/125; 399/110; 271/220

(58) Field of Classification Search ..... 271/264, 271/267, 220, 213; 399/124, 125, 110, 405
See application file for complete search history.

(56) References Cited

U.S. PATENT DOCUMENTS 5,284,337 A * 2/1994 Ettischer et al. ..... 271/220
5,418,606 A * 5/1995 Kikuchi et al. ..... 399/381
6,308,952 B1 * 10/2001 Takagi et al. ..... 271/297
6,824,128 B2 * 11/2004 Nagata et al. ..... 270/58.08
6,997,456 B2 2/2006 Fukatsu et al.
7,226,050 B2 6/2007 Sekiyama et al. ..... 271/213
7,237,774 B2 7/2007 Fukatsu et al. ..... 271/207
7,258,339 B2 8/2007 Fukatsu et al. ..... 271/220
7,270,324 B2 9/2007 Ogata et al. ..... 271/220
7,558,493 B2 * 7/2009 Kwon ..... 399/16
2005/0127598 A1 * 6/2005 Nagura ..... 271/264
2005/0220521 A1 10/2005 Kuwata et al. ..... 399/407
2006/0071423 A1 4/2006 Ata et al. ..... 271/303
2006/0255524 A1 11/2006 Isobe et al. ..... 270/58.08

OTHER PUBLICATIONS

Official Action dated May 8, 2009, issued by The Patent Office of the People's Republic of China, in Chinese Application No. 200710091469.0. (Translation).

* cited by examiner

*Primary Examiner*—Patrick H Mackey
*Assistant Examiner*—Ernesto Suarez
(74) *Attorney, Agent, or Firm*—Fitzpatrick, Cella, Harper & Scinto

(57) ABSTRACT

A presser member which abuts on a sheet which passes through a sheet conveyance path, and rotates toward a sheet conveyance direction while being pressed by the sheet is provided rotatably in the sheet conveyance path where the sheet conveyed to a sheet stack portion passes, and a move portion to which this presser member is retracted from the sheet conveyance path is provided. When drawing out a jammed sheet from the sheet conveyance path in a direction reverse in a sheet conveyance direction, a jam recovery door is opened, the move portion is operated in connection with this opening motion, and the presser member is retracted from the sheet conveyance path.

12 Claims, 16 Drawing Sheets

SHEET CONVEYANCE APPARATUS, SHEET PROCESSING APPARATUS, AND IMAGE FORMING APPARATUS

BACKGROUND OF THE INVENTION

1. Field of the Invention

The present invention relates to a sheet conveyance apparatus, a sheet processing apparatus, and an image forming apparatus, and in particular, to a sheet conveyance apparatus, a sheet processing apparatus, and an image forming apparatus which can recover a jammed sheet easily without damaging the sheet.

2. Description of the Related Art

Heretofore, in image forming apparatuses such as a copier, in order to save the time and effort of, for example, binding to sheets after image formation, there are those including a sheet processing apparatus which takes sheets after image formation sequentially into the apparatus, and performs binding or the like to these sheets.

Then, such sheet processing apparatuses, some have a function of conveying sheets into an intermediate stack portion by a sheet conveyance apparatus, aligning ends of the sheets in the intermediate stack portion, and binding the sheets by a binding unit, such as a stapler (for example, refer to U.S. Pat. No. 6,997,456).

FIG. 16 illustrates construction of a sheet processing apparatus including such a conventional sheet conveyance apparatus. A sheet S on which an image is formed is conveyed into an intermediate stack portion 101 by an intermediate roller 102. Then, the sheet which is stacked in the intermediate stack portion 101 in this way is returned to a direction reverse to a conveyance direction by a return unit not illustrated to abut on an alignment reference wall 104, and alignment of rear ends in the conveyance direction is performed.

By the way, when a sheet is conveyed, when a preceding sheet S previously stacked in the intermediate stack portion 101 floats above a nip line of the intermediate roller 102, a subsequent sheet collides with the preceding sheet S, and alignment may be disordered or a jam may be generated.

Then, conventionally, a rear end presser member 103 is provided so as to prevent a lift of a rear end portion of the preceding sheet S, and this rear end presser member 103 presses the rear end portion of the preceding sheet S stacked in the intermediate stack portion 101. In addition, in order to restrict a position of the rear end of the preceding sheet S by a bottom end and to prevent the lift, this presser member 103 is rotatably provided downstream from a nip position of the intermediate roller 102 while being urged in a direction reverse to a sheet conveyance direction shown by an arrow B.

Then, until the presser member 103 is pressed by an end of the subsequent sheet to rotate, a rear end of the preceding sheet S is located below the nip line of the intermediate roller 102 by such the presser member 103. Thereby, when the presser member 103 rotates, the end of the subsequent sheet has been already conveyed to the downstream from the rear end of the preceding sheet S, and hence, the end of the subsequent sheet never collides with the rear end of the preceding sheet S.

By the way, when a jam is generated in the intermediate stack portion 101 of the sheet processing apparatus with such construction, a user puts his/her hand into the intermediate stack portion from a sheet discharge port 105, provided downstream in the sheet conveyance direction, to take out a jammed sheet.

By the way, in such conventional sheet conveyance apparatuses, sheet processing apparatuses, and image forming apparatuses, some may have an intermediate stack portion which is too long in a conveyance direction for a user's hand to reach its back. In addition, for example, in the case of an intra-body sheet discharge type apparatus in which an image scanner is arranged with a space being provided in an upper portion of a main body of an image forming apparatus, since the image scanner restricts a vertical direction, it is hard to access the intermediate stack portion from a sheet discharge port.

Hence, in order to increase operability including also a case of processing sheets which are accumulated in the intermediate stack portion, it is necessary to enable to perform jam recovery in the intermediate stack portion from the downstream in the sheet conveyance direction as well as from the upstream of an intermediate conveying roller.

Then, conventionally, for example, a jam recovery cover not illustrated is provided upstream from the intermediate stack portion. Then, when a rear end of the jammed sheet projects upstream from the intermediate roller 102, jam recovery is performed by opening the jam recovery cover and drawing out the sheet from the upstream of the intermediate conveying roller.

Here, when jam recovery is performed from the upstream of the intermediate conveying roller in this way, the jammed sheet is processed by being drawn in a direction reverse to the sheet conveyance direction. But, in the vicinity of the intermediate conveying roller, a lot of small parts are arranged in a narrow space, for example, in order to suppress curl of a sheet.

For this reason, when trying to recover the jammed sheet with drawing the jammed sheet in the reverse direction, for example, a strong force is applied in the direction reverse to the sheet conveyance direction to the presser member 103 which is constructed so as to be easy to rotate in the sheet conveyance direction. Hence, there is a possibility that the presser member 103 may be damaged.

For this reason, in the case of performing jam recovery, it is necessary to remove the jammed sheet with paying attention to the presser member 103 and taking time. Hence, the jam recovery takes time and effort. In addition, it leads to a cost hike that reinforcement of the presser member 103 is performed so that the presser member 103 may not be damaged.

In addition, there were problems that the presser member 103 was damaged by a user touching the presser member 103 at the time of jam recovery, and that the presser member 103 caught a jammed sheet to tear the jammed sheet, a part of which was left in the intermediate stack portion. Furthermore, in conventional construction, unless a rear end of a sheet projected from the intermediate conveying roller to the upstream, jam recovery from the upstream in the sheet conveyance direction was not completed.

SUMMARY OF THE INVENTION

Then, the present invention is made in view of such the present circumstances, and aims at providing a sheet conveyance apparatus, a sheet processing apparatus, and an image forming apparatus which can recover a jammed sheet easily without damaging the sheet.

The present invention is a sheet conveyance apparatus which conveys a sheet, including a sheet conveyance path through which a sheet passes, a moving member which is movably provided in the above-described sheet conveyance path, a move portion which retracts the above-described moving member from the above-described sheet conveyance path, and a cover member which opens to expose the above-described sheet conveyance path, and is characterized in that the above-described move portion moves the above-described moving member to an retracting position from the above-described sheet conveyance path in a direction opposed to the opening direction of the cover member according to opening of the above-described cover member.

Like the present invention, by retracting a moving member from a sheet conveyance path by a move unit when drawing out a jammed sheet from the sheet conveyance path in a direction reverse to a sheet conveyance direction, the jammed sheet can be recovered easily without being damaged.

Further features of the present invention will become apparent from the following description of exemplary embodiments with reference to the attached drawings.

BRIEF DESCRIPTION OF THE DRAWINGS

FIGS. 6A and 6B are first diagrams for describing operations of a first presser member and a second presser member, which are provided in the above-described sheet processing apparatus, at the time of a sheet carrying-in.

FIGS. 7A and 7B are second diagrams for describing operations of a first presser member and a second presser member, which are provided in the above-described sheet processing apparatus, at the time of a sheet carrying-in.

DESCRIPTION OF THE EMBODIMENTS

Exemplary embodiments for carrying out the present invention will be described in detail using diagrams.

Figure 1:
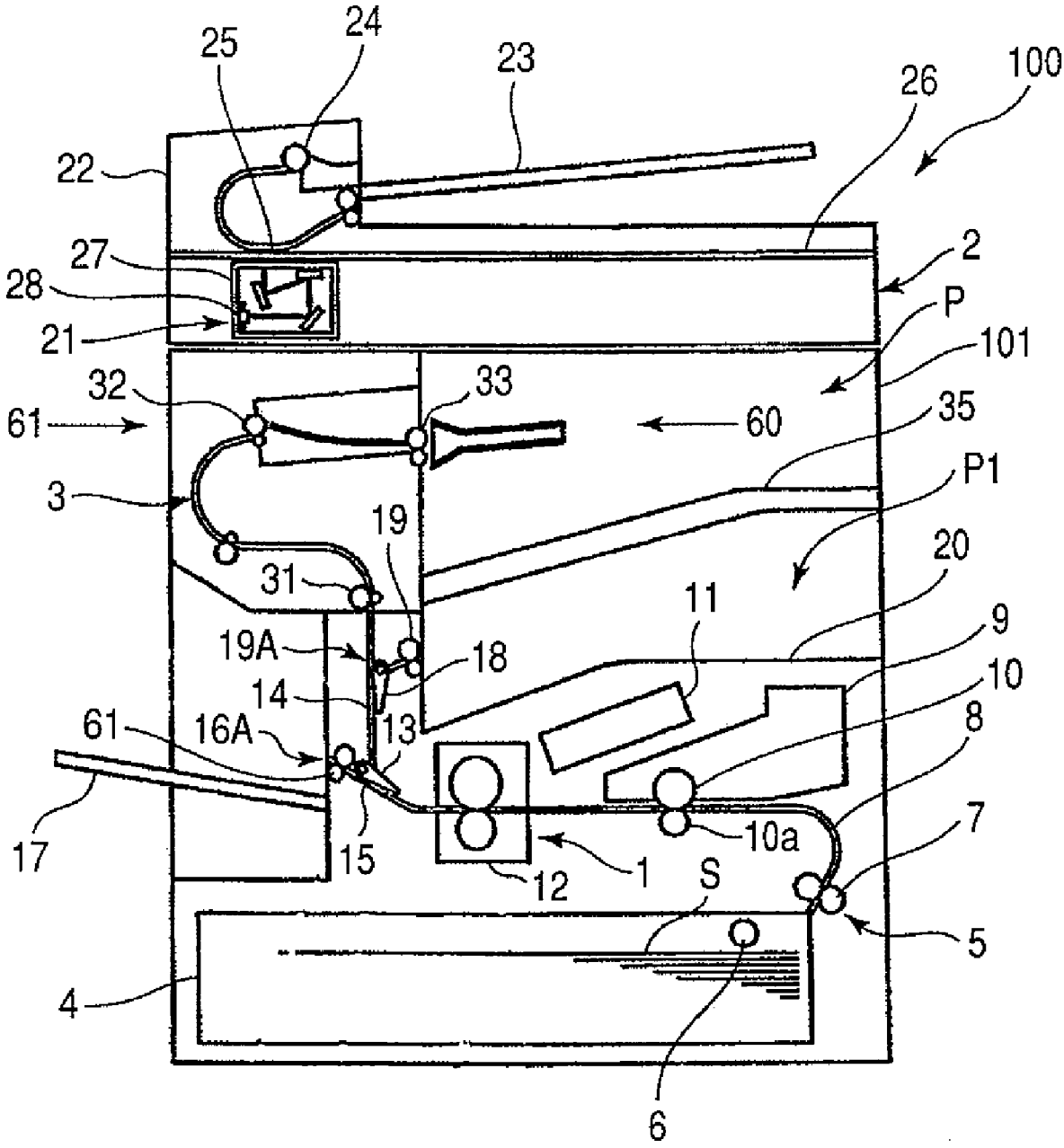
FIG. 1 is a diagram illustrating schematic construction of an image forming apparatus including a sheet processing apparatus according to a first embodiment of the present invention.

FIG. 1 is a diagram illustrating schematic construction of an image forming apparatus including a sheet processing apparatus according to a first embodiment of the present invention. FIG. 1 illustrates an image forming apparatus 100, a main body 101 of the image forming apparatus including an image forming portion 1, and the like. Above this main body 101 of the image forming apparatus, a sheet processing apparatus 3 is provided which performs processing such as stapling for sheets which are selectively conveyed after images are formed by the image forming portion 1. And, further above this sheet processing apparatus 3, an image scanner 2 is installed.

In addition, this image forming apparatus 100 is an intra-machine sheet discharge type apparatus in which the discharged sheet space P which discharges a sheet on which an image is formed by the image forming portion 1, or a sheet which is processed by the sheet processing apparatus 3 is provided between the image scanner 2 and a sheet discharge tray 35 provided in the sheet processing apparatus 3.

Here, the image scanner 2 which reads an original image has a scanner section 21 which is an image reading unit, and an automatic document feeder (ADF) 22. In addition, this ADF 22 is an apparatus which conveys each one with separating two or more sheets of original stacked on an original stacking tray 23 by a feeding roller 24 and a separation pad not illustrated, and makes each sheet of the original pass through the original reading position 25, when reading original entry information optically by the scanner section 21. In addition, this ADF 22 can be opened backward and closed with centering a hinge, which is not illustrated, back the apparatus, and is made to be opened and closed in the case of placing an original on an original plate 26.

The scanner section 21 includes an optical carriage 27 which reads an image of the original placed on the original plate while scanning the original in a transverse direction along a guide axis not illustrated. The scanner section 21 is made to perform photo-electric conversion of the original information, read by this optical carriage 27, by a CCD 28. In addition, at the time of reading the original by the ADF 22, the optical carriage 27 stops in a predetermined position and reads the original under conveyance.

The main body 101 of the image forming apparatus includes an image forming portion 1 which forms an image (toner image) in an electrophotographying system, a sheet feeding portion 5 which feeds a sheet to the image forming portion 1, a fixing portion 12, and first and second sheet discharge portions 16A and 19A.

Here, the image forming portion 1 includes a photosensitive drum 10, a process cartridge 9 including a charging roller, a developer, a toner container, and the like which are not illustrated, and a laser scanner 11 which exposes a surface of the photosensitive drum 10 and forms an electrostatic latent image on the photosensitive drum.

In addition, the sheet feeding portion 5 has a sheet feeding cassette 4 in which two or more sheets S which are fed for image formation are contained in a stacked condition, and a pickup roller 6 which feeds the sheet S contained in the sheet feeding cassette 4.

The first sheet discharge portion 16A has a first flapper 13, a first sheet discharge roller 16, and a face-up conveying path 15. The second sheet discharge portion 19A has a second flapper 18, a second sheet discharge roller 19, and a face-down conveying path 14.

In addition, the second flapper 18 is switchable in between a position which is illustrated in FIG. 1 makes a sheet after image formation go to the sheet processing apparatus 3, and a sheet discharge position which discharges a sheet to a discharged sheet stack portion 20 provided in a discharged sheet space P1 formed between the sheet processing apparatus 3 and the image forming portion 1. In addition, the first flapper 13 is switchable in between a position which is illustrated in FIG. 1 and discharges a sheet after image formation to a sheet discharge tray 17 in face-up, and a discharge position which makes a sheet after image formation go to the face-down conveying path 14.

Figure 2:
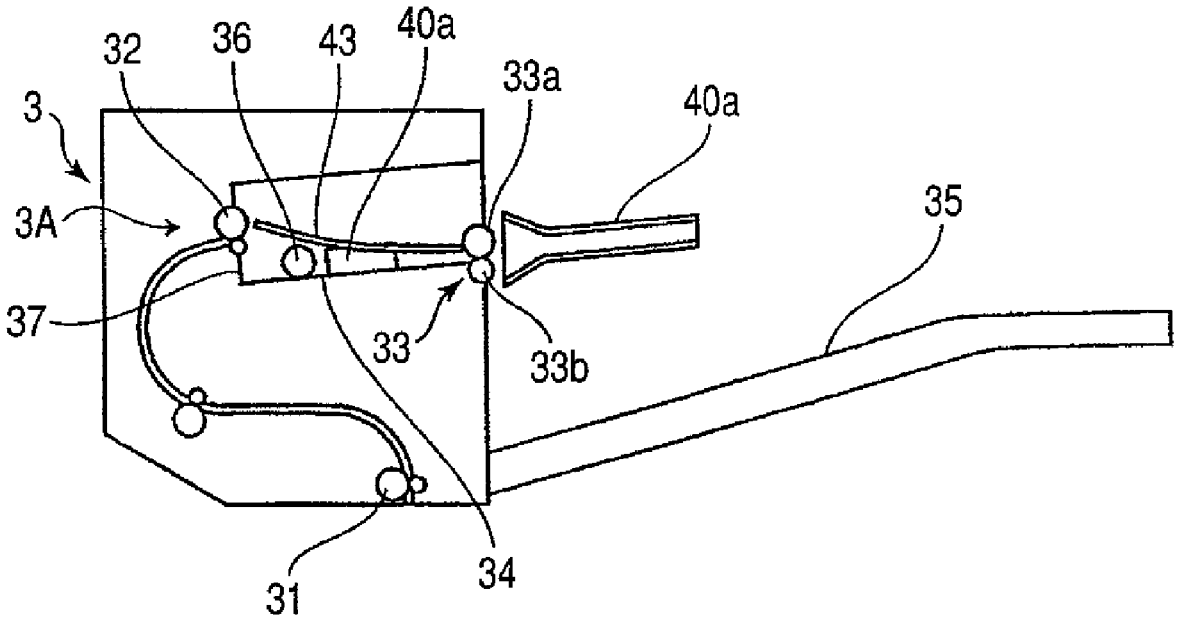
FIG. 2 is a diagram for describing construction of the above-described sheet processing apparatus.

Furthermore, the sheet processing apparatus 3 performs processing, such as stapling, for the sheet guided selectively with the switching of the second flapper 18. Then, as illustrated in FIG. 2, the sheet processing apparatus 3 includes an intermediate stack portion 34 as a sheet stack portion for processing a sheet, an intermediate conveying roller 32 which conveys a sheet to the intermediate stack portion 34, and a sheet discharge roller pair 33 which discharges a sheet which is given processing in the intermediate stack portion 34 and is separable.

Moreover, the sheet processing apparatus 3 includes a first alignment reference wall 37 which abuts on a rear end of a sheet conveyed into the intermediate stack portion 34 to align a position of the sheet in a conveyance direction. Furthermore, the sheet processing apparatus 3 includes an alignment roller 36 which conveys a sheet, conveyed into the intermediate stack portion 34, toward the first alignment reference wall, and makes the rear end of a sheet abut on the first alignment reference wall 37.

In addition, a sheet conveyance apparatus 3A conveys a sheet. This sheet conveyance apparatus 3A includes the intermediate stack portion 34, and a sheet conveyance path R and a first presser member 38 which will be described later.

Furthermore, an entrance roller 31 conveys a sheet, conveyed by switching of the second flapper 18 into the sheet processing apparatus 3, to the intermediate conveying roller 32. The sheet discharge tray 35 stacks a sheet discharged by the sheet discharge roller pair 33 after processing of stapling and the like. A conveyance guide 43 is provided above the intermediate stack portion 34 and guides a sheet, which is conveyed by the intermediate conveying roller 32 to the intermediate stack portion 34.

Next, an operation of the image forming apparatus 100 as constructed in this way at the time of image formation will be described.

When an image is formed on a sheet, an original is first set on the original stacking tray 23 of the ADF 22, and then, when a copy button is pressed, the original is conveyed by the sheet feeding roller 24 of the ADF 22 to the original reading position 25. Then, light is radiated from a light source, not illustrated, on this original, the optical carriage 27 reads the reflected light, the CCD 28 performs photo-electric conversion of the image signal read in this way, and thereafter, the image signal is transferred to the laser scanner 11 of the image forming portion 1.

Next, when an image signal is input in this way, the laser scanner 11 radiates a laser beam according to the image signal on the photosensitive drum 10, and thereby, an electrostatic latent image is formed on the photosensitive drum 10. After this, this electrostatic latent image is developed by a developer not illustrated, and is visualized as a toner image. The toner image formed on the photosensitive drum 10 in this way is carried with rotation of the photosensitive drum 10 to a transfer nip portion between the photosensitive drum 10 and the transfer roller 10*a*.

On the other hand, sheets S which are provided for image formation are separated into one sheet by the pickup roller 6 and the separation roller pair 7 from the sheet feeding cassette 4, and each sheet S is supplied to the transfer nip portion along with the conveyance guide 8 after this. Thereby, the toner image on the photosensitive drum 10 is transferred on the sheet S by the transfer roller 10*a*.

Then, the sheet S on which the toner image is transferred from the photosensitive drum 10 in this way is carried to the fixing portion 12. The toner image is fixed on a surface of the sheet S by heating and pressurization in this fixing portion 12.

Here, when processing of the sheet S is unnecessary and the sheet S is discharged in face-up, the first flapper 13 is set in a sheet discharge position illustrated in FIG. 1. Thereby, the sheet S after toner image fixing is conveyed along the face-up conveying path 15, and is discharged in a face-up state, that is, in a state, where a surface where the toner image is formed faces upward, into the sheet discharge tray 17 by the first sheet discharge roller 16.

On the other hand, when the processing of a sheet is unnecessary and the sheet is discharged in face-down, the first flapper 13 is set in a discharge position for making the sheet S go to the face-up conveying path 14. In addition, the second flapper 18 is set in a sheet discharge position for discharging a sheet to the discharged sheet stack portion 20 which is provided in the discharged sheet space P.

Thereby, after the sheet S after toner image fixing is conveyed along the face-down conveying path 14, the sheet S is discharged in a face-down state, that is, in a state, where a surface where the toner image is formed faces downward, into the discharged sheet stack portion 20 by the second sheet discharge roller 19.

In addition, when it is set to perform processing, such as stapling, for a sheet after image formation, or when it is set to discharge the sheet from the sheet processing apparatus 3 without processing, the second flapper 18 is beforehand switched to the position illustrated in FIG. 1.

Then, owing to such switching of the second flapper 18, the sheet S is conveyed to the intermediate stack portion 34 through the entrance roller 31, and the intermediate conveying roller 32 and a driven roller 32*b* which construct a sheet conveying roller pair. In addition, as for the sheet discharge roller pair 33 illustrated in FIG. 2, an upper roller 33*a* is supported separably from a lower roller 33*b*. Then, since the discharge roller pair 33 separates from each other when the sheet S is conveyed to the intermediate stack portion 34 in this way, the sheet S is never discharged by the discharge roller pair 33.

Then, as for the sheets conveyed to the intermediate stack portion 34, individual alignment in a conveyance direction and a width direction is performed, and, an aligned sheet bundle is given stapling (binding). Then, the discharge roller pair 33 having separated from each other abuts on each other after completion of the stapling, and the sheet bundle is discharged to the sheet discharge tray 35 by this discharge roller pair 33.

On the other hand, although the sheet S is discharged from the sheet processing apparatus 3, when stapling is not performed, the sheet S conveyed by the intermediate conveying roller 32 is discharged by the discharge roller 36 to the sheet discharge tray 35 without being temporarily accumulated in the intermediate stack portion 34.

Figure 3:
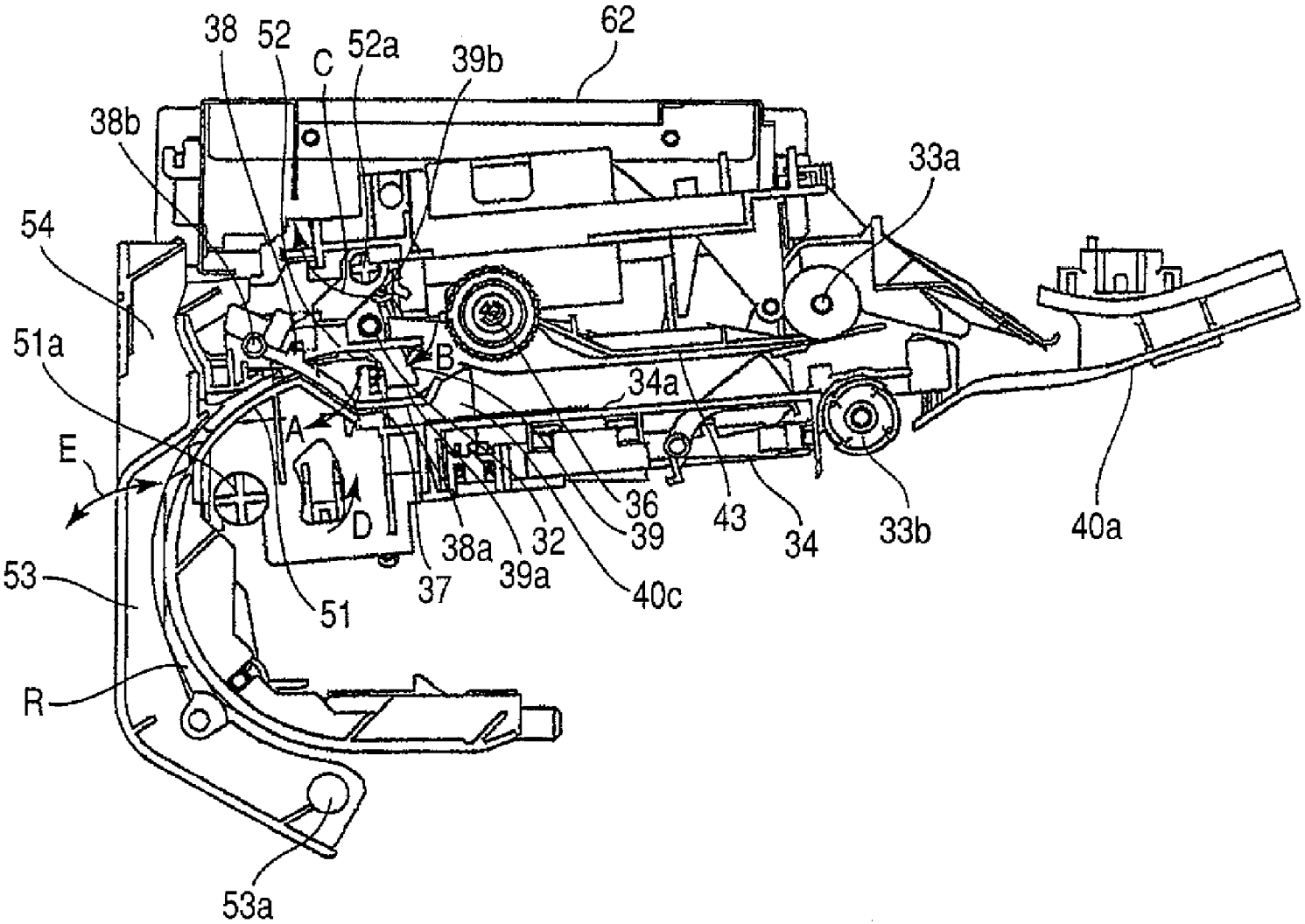
FIG. 3 is a sectional diagram for describing construction of the above-described sheet processing apparatus.
Figure 4:
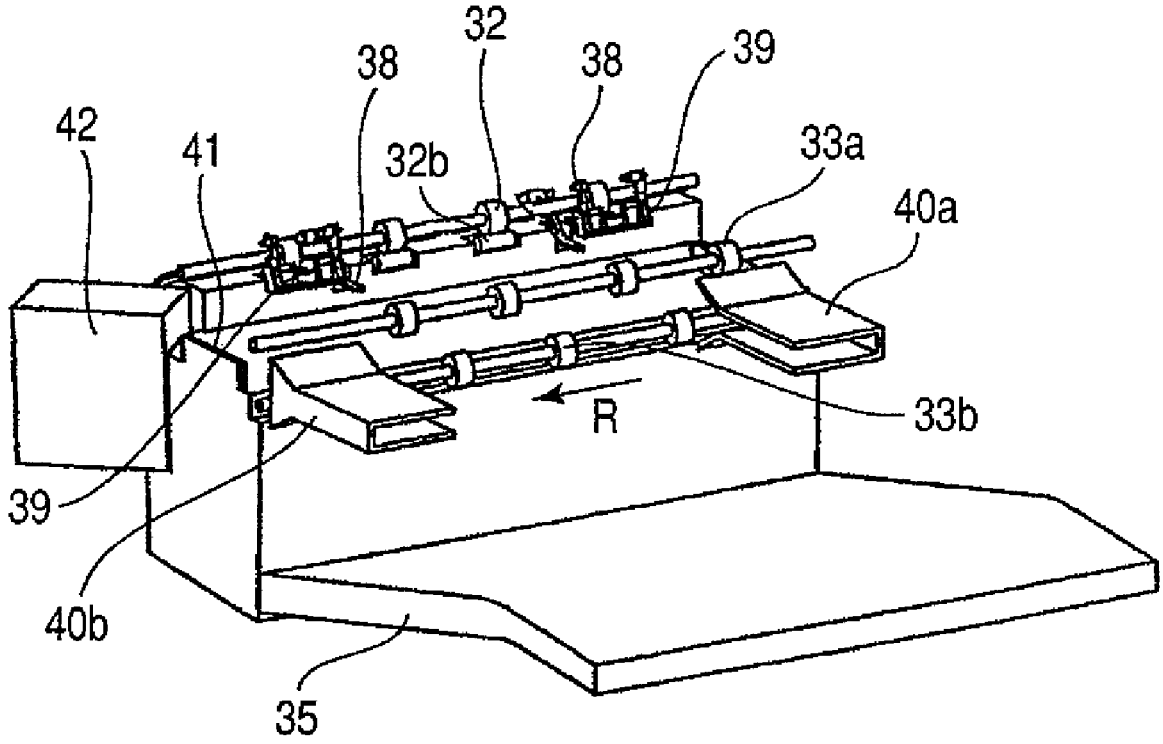
FIG. 4 is a perspective view of the above-described sheet processing apparatus.
Figure 5:
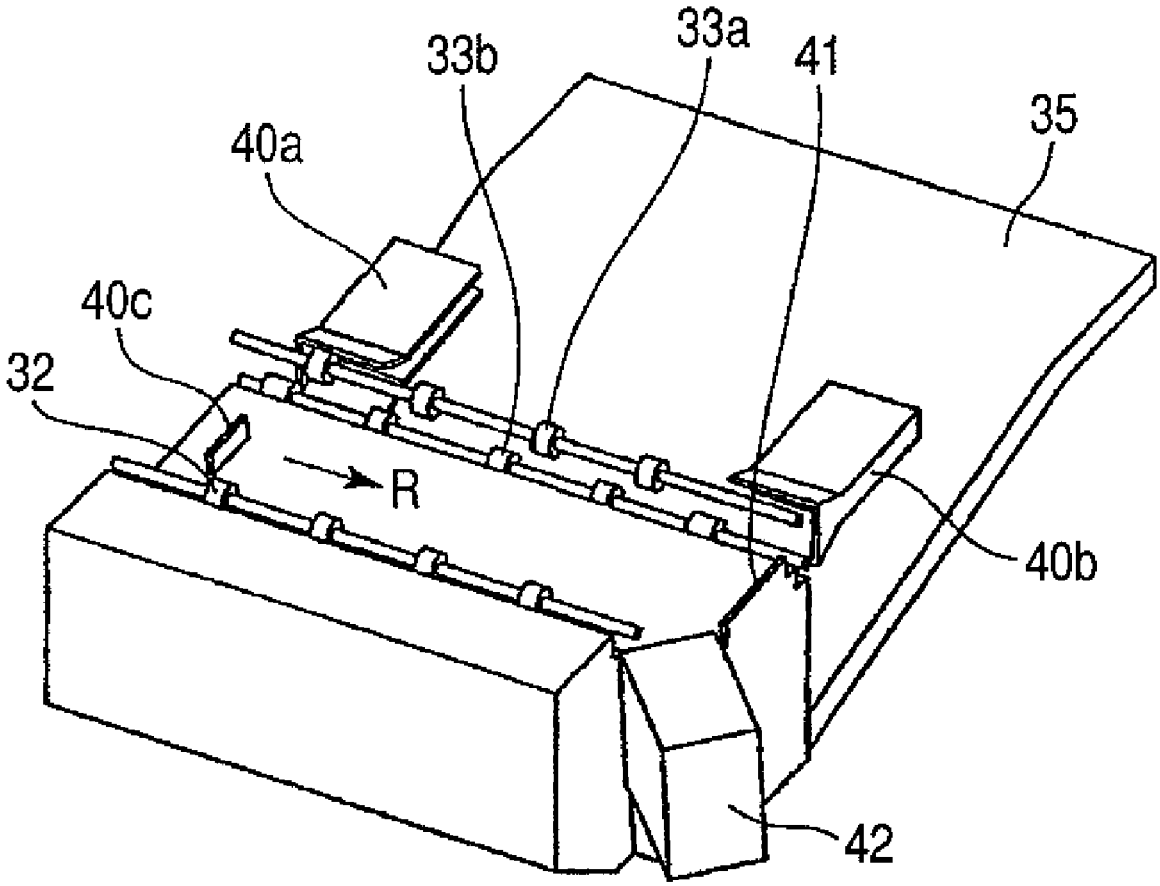
FIG. 5 is another perspective view of the above-described sheet processing apparatus.

By the way, the intermediate stack portion 34 which is a sheet stack portion stacking sheets to be processed includes a second alignment reference wall 41 which aligns a position of a sheet in a width direction as illustrated in FIGS. 3 to 5. In addition, the intermediate stack portion 34 includes first to third joggers 40*a*, 40*b*, and 40*c* which are abutting units which move a sheet in a direction (hereinafter, a width direction) orthogonal to the conveyance direction to make the sheet abut on the second alignment reference wall 41. In addition, the intermediate stack portion 34 includes a stapler 42, which staples an aligned sheet bundle, as a sheet processing unit.

In addition, these first to third joggers 40*a*, 40*b*, and 40*c* each include sheet alignment surfaces to abut on side ends of the sheet S1. In addition, in this embodiment, the first and second joggers 40*a* and 40*b* each have an angular U-shape so as to support a sheet from a lower part. Furthermore, a lower face which supports the sheet from the lower part can retract to a position, where the lower face becomes outside width of a sheet, so as to be able to discharge sheets after stapling to the sheet discharge tray 35.

In addition, owing to an interlock not illustrated, the third jogger 40*c* which exists upstream from the sheet discharging roller pair 33 moves to a width direction with being interlocked with the first jogger 40*a*. Thereby, the first and third joggers 40*a* and 40*c* can align a sheet synchronously. Furthermore, the second jogger 40*b* arranged toward the second alignment reference wall 41 is fixed in a position where a sheet alignment surface becomes flush with the second alignment reference wall 41.

The alignment roller 36 is movable vertically to the intermediate stack portion 34. The alignment roller 36 abuts on a surface of a sheet in the intermediate stack portion 34 at the time of lowering to make the sheet S1 go to the first alignment reference wall 37 which is a first aligning portion which aligns a rear end position of the sheet in the conveyance direction. In addition, the alignment roller 36 retracts to a position which enables a sheet to being conveyed into the intermediate stack portion 34 without a hitch at the time of lifting.

Furthermore, as illustrated in FIG. 3, this intermediate stack portion 34 includes a first presser member 38, a second presser member 39, a lower conveyance guide 51, an upper conveyance guide 52, and a jam recovery door 53. In addition, these first and second presser members 38 and 39, lower and upper conveyance guides 51 and 52, and jam recovery door 53 are held rotatably in a frame 62 of the sheet processing apparatus 3, respectively.

Here, the first presser member 38 which is a moving member abuts on the intermediate conveying roller 32 and the intermediate conveying roller 32, and is held rotatably with a rotating shaft 38*b*, provided upstream from a nip position of the driven roller 32*b* (refer to FIG. 4) which constructs the sheet conveying roller pair, as a fulcrum. Furthermore, the first presser member 38 is urged in a direction, shown by an arrow A, by an urge member such as a spring not illustrated.

In addition, when a sheet is conveyed to the intermediate stack portion 34, this first presser member 38 rotates upward (toward the sheet conveyance direction) while being pressed by the sheet to retract toward a conveyable position where conveyance of a sheet is not disturbed. In addition, hereafter, a position illustrated in FIG. 3 is called a first position, and the position where conveyance of a sheet is not disturbed is called a second position (retracting position). Then, when the sheet is not conveyed, the first presser member 38 is in the first position which is upper by a predetermined distance than a stacking surface 34*a* of the intermediate stack portion 34. A lower face 38*a* to abut on a sheet protrudes from the first alignment reference wall 37.

The second presser member 39 as a presser member is held rotatably with using a rotating shaft 39*b* as a fulcrum, downstream from the nip position of the sheet conveying roller pair, including the intermediate conveying roller 32 and the driven roller 32*b*, in a position of abutting on an end of a sheet. Furthermore, the second presser member 39 is urged in a direction, shown by an arrow B, by an urge member such as a spring not illustrated.

In addition, when a sheet is conveyed to the intermediate stack portion 34, this second presser member 39 also rotates upward while being pressed by the sheet to retract to a position where conveyance of a sheet is not disturbed. In addition, when a sheet is not conveyed, the lower face 38*a* of the first presser member 38 is located below a lower face 39*a* of the second presser member.

The upper conveyance guide 52 as the upper guide member constructs a sheet conveyance path R, through which a sheet conveyed into the intermediate stack portion 34 passes, with the lower conveyance guide 51 as the lower guide member, and the jam recovery door 53. While being held rotatably with using the rotating shaft 52*a* as a fulcrum, the upper conveyance guide 52 is pulled up in a direction shown by an arrow C by a spring not illustrated. Here, the rotating shaft 38*b* of the first presser member 38 which is a moving member is installed in this upper conveyance guide 52. And, the upper conveyance guide 52 is held in a position illustrated in FIG. 3 while being pressed down from the above by the jam recovery door 53.

In addition, when the jam recovery door 53 is opened, the sheet conveyance path R is exposed, and the upper conveyance guide 52 is opened with the spring not illustrated. Thus, with opening of the jam recovery door 53 as a cover member, the upper conveyance guide 52 moves in a direction of moving the first presser member 38 upward as described later.

While being held rotatably with having a rotating shaft 51*a* as a fulcrum, the lower conveyance guide 51 is urged in a direction shown by an arrow D by a spring not illustrated. In addition, the reference wall 37 and the driven roller 32*b* (refer to FIG. 4) are provided in this lower conveyance guide 51. Furthermore, the lower conveyance guide 51 can be pressed down manually with using the rotating shaft 51*a* as a fulcrum, when the jam recovery door 53 is opened as described later.

When a jammed sheet is drawn out in a direction reverse to the conveyance direction, while the jam recovery door 53 which is a cover member opened is rotatably held with using the rotating shaft 53*a* as a fulcrum, the jam recovery door 53 can be opened and closed with a handle 54 in a direction illustrate by an arrow E.

Next, an operation of sheet processing in the sheet processing apparatus 3 as constructed in this way will be described.

When a sheet is conveyed to the sheet processing apparatus 3, the sheet conveyed by the entrance roller 31 is discharged to the intermediate stack portion 34 by the intermediate conveying roller 32. In addition, before a sheet is conveyed to the intermediate stack portion 34, the first to third joggers 40*a* to 40*c* are moved to positions where an interval between sheet alignment surfaces is wider by a predetermined amount than width of a sheet conveyance area. Thereby, while a sheet is conveyed to the intermediate stack portion 34 without bumping on the first to third joggers 40*a* to 40*c*, a lower face of the sheet is supported by the first to third joggers 40*a* to 40*c*.

In addition, the sheet discharging roller pair 33 separates from each other until before a rear end of a sheet escapes from the intermediate conveying roller 32 at the latest, and stops rotation. Owing to this, the sheet escaping from the intermediate conveying roller 32 is stacked into the intermediate stack portion 34.

Then, after stacking the sheet S1 onto the intermediate stack portion 34 in this way, the sheet processing apparatus 3 moves the first jogger 40*a*, and the third jogger 40*c*, interlocked with the first jogger 40*a*, first in a direction of an arrow R illustrated in FIGS. 4 and 5, and moves the sheet in a width direction.

At this time, as describes above, the second jogger 40*b* is fixed in the position where the sheet alignment surface becomes flush with the second alignment reference wall 41. Then, when a sheet is moved by the first and third joggers 40*a* and 40*c* in this way, side ends of the sheet abut on a sheet alignment surface of the second jogger 40*b* and the second alignment reference wall 41, and, thereby, a position of a sheet S1 in a width direction is aligned.

Next, after such alignment of side end positions of the sheet is completed, the alignment roller 36 drops and abuts on a surface of the sheet. Then, the sheet processing apparatus 3 moves the sheet toward the first alignment reference wall 37, and makes a rear end of the sheet abut on the first alignment reference wall 37. Thereby, a rear end position of a sheet is restricted and alignment of the sheet in the conveyance direction is performed. Then, such an operation is repeated until the number of sheets reaches a predetermined number of sheets to be bound.

Then, after completing alignment of the last sheet, the sheet processing apparatus 3 moves the first and third joggers 40*a* and 40*c* to positions of abutting on end faces of the sheets to make the sheets aligned completely. Then the sheet processing apparatus 3 drives the stapler 42, which is a binding unit, to bind the sheets. Then, the sheet processing apparatus 3 not only retracts completely the first and second joggers 40*a* and 40*b* to positions where a lower face is wider than width of the sheet, but also makes the discharge roller pair 33 abut to convey the sheet bundle. Thereby, the sheet bundle is discharged and stacked onto the sheet discharge tray 35.

Next, operations of the first presser member 38 and the second presser member 39 at the time of a sheet carrying-in will be described.

Figure 6A:
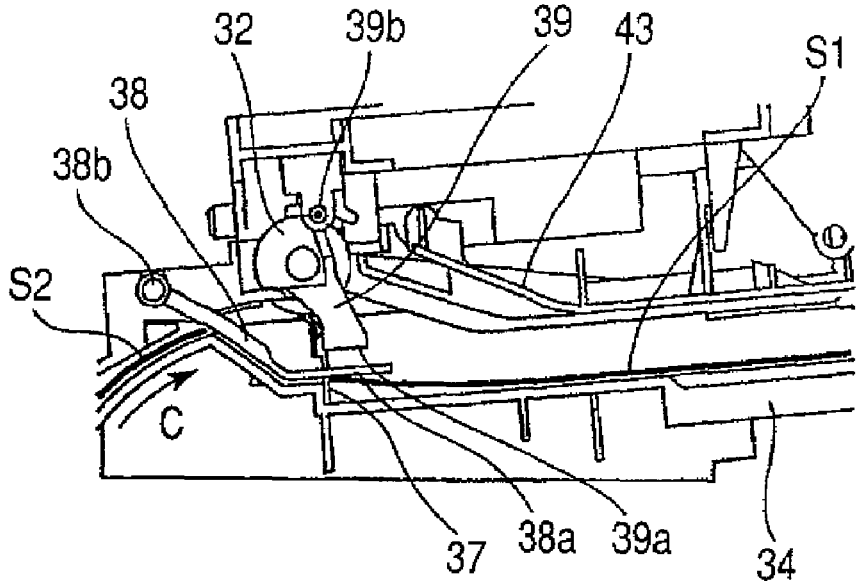
Figure 6B:
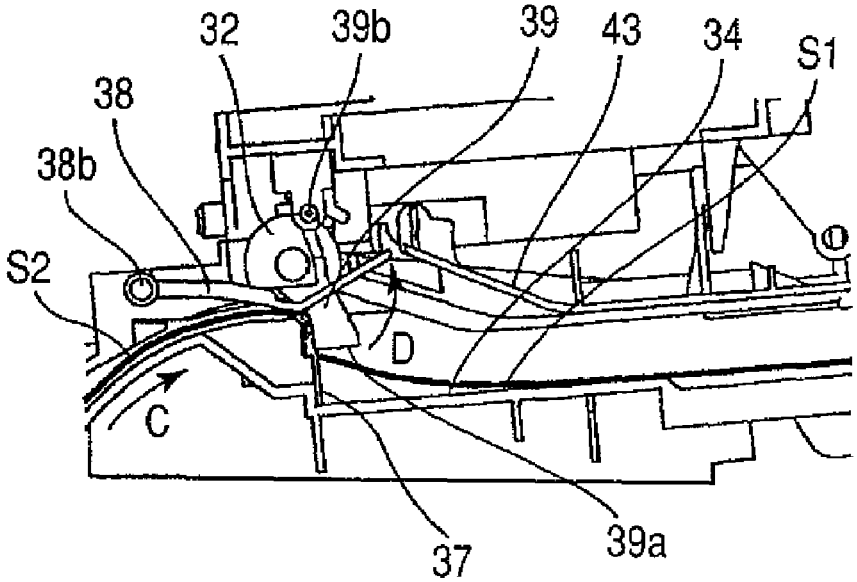

FIG. 6A illustrates a state that a preceding sheet S1 has been already stacked onto the intermediate stack portion 34. At this time, a rear end of the preceding sheet S1 is restricted by the first presser member 38 for upward movement. Then, when a subsequent sheet S2 is conveyed from a direction shown by an arrow C in this state, the subsequent sheet S2 abuts on the first presser member 38 before reaches the intermediate conveying roller 32. Then, as illustrated in FIG. 6B, the first presser member 38 is rotated in a direction shown by an arrow D.

Figure 7A:
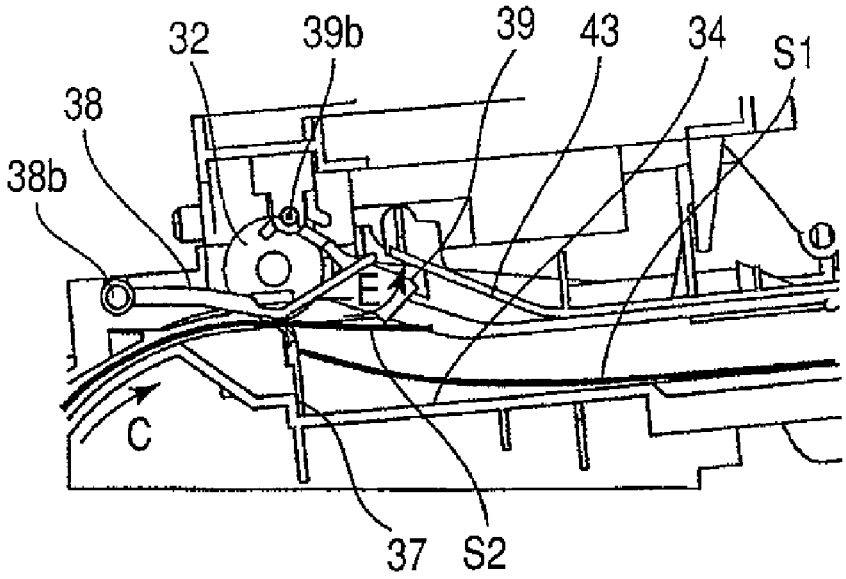

Next, an end of the subsequent sheet S2 is nipped by the intermediate conveying roller 32 to abut on the second presser member 39. Then, as illustrated in FIG. 7A, the second presser member 39 is rotated in a direction shown by an arrow E. In addition, when the second presser member 39 starts to rotate by the subsequent sheet S2, the end of the subsequent sheet S2 and the rear end of the preceding sheet S1 are almost flush in the conveyance direction. For this reason, when the rear end of the preceding sheet S1 floats by the second presser member 39 rotating, the end of the subsequent sheet S2 has been already moved to the downstream from the rear end of the preceding sheet S1. Owing to this, the end of the subsequent sheet S2 never collides with the rear end of the preceding sheet S1.

Figure 7B:
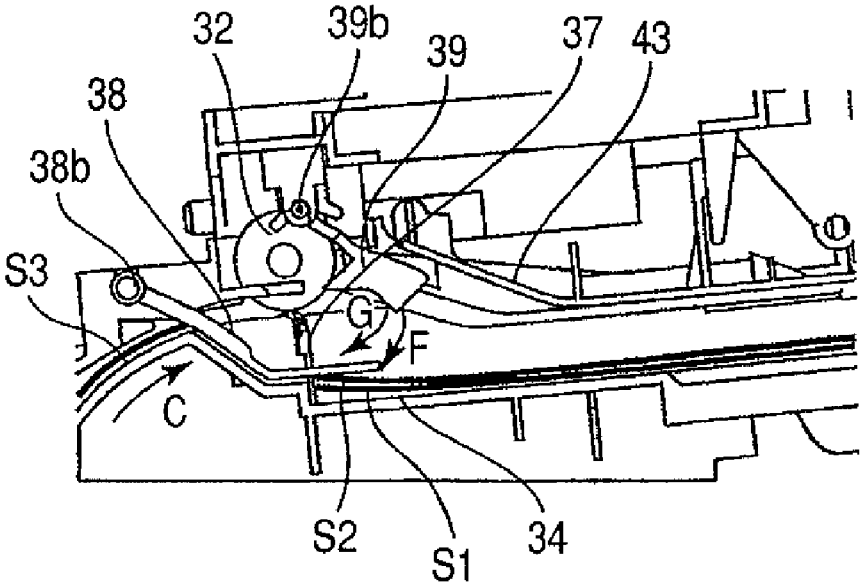

Subsequently, when the rear end of the subsequent sheet S2 escapes from the nip of the intermediate conveying roller 32, as shown in FIG. 7B, the first presser member 38 rotates in a direction shown by an arrow F to return to a predetermined position. Then, the first presser member 38 presses the subsequent sheet S2 and the rear end of the preceding sheet S1 in the intermediate stack portion 34.

Here, as described already, the first presser member 38 is arranged so that the rotating shaft 38*b* may be located upstream from the intermediate conveying roller 32, and that an end of a sheet may abut upstream from the intermediate conveying roller 32. Furthermore, the first presser member 38 is urged in a direction shown by an arrow F, that is, in a direction of pressing a rear end of the sheet, stacked in the intermediate stack portion 34, in the intermediate stack portion 34 by an urge member not illustrated. Thereby, even if curl of the rear end of a sheet is large, the intermediate stack portion 34 can be pressed down securely.

In addition, when the subsequent sheet S2 escapes from the intermediate conveying roller 32, the second presser member 39 also rotates in a direction shown by an arrow G and returns to the specified position, owing to an urging force. At this time, since the first presser member 38 presses down a rear end of the sheet, the second presser member 39 can return to the predetermined position securely without being disturbed by a lift of the rear end of the sheet. When the following sheet S3 is conveyed, the second presser member 39 can return to a state illustrated in FIG. 6A.

Furthermore, when sheets are stacked onto the intermediate stack portion 34 in this way, as described already, the sheets are aligned by the first to third joggers 40*a* to 40*c* and the alignment roller 36.

Next, recovery at the time of a sheet jam in the sheet processing apparatus 3 will be described.

Figure 8:
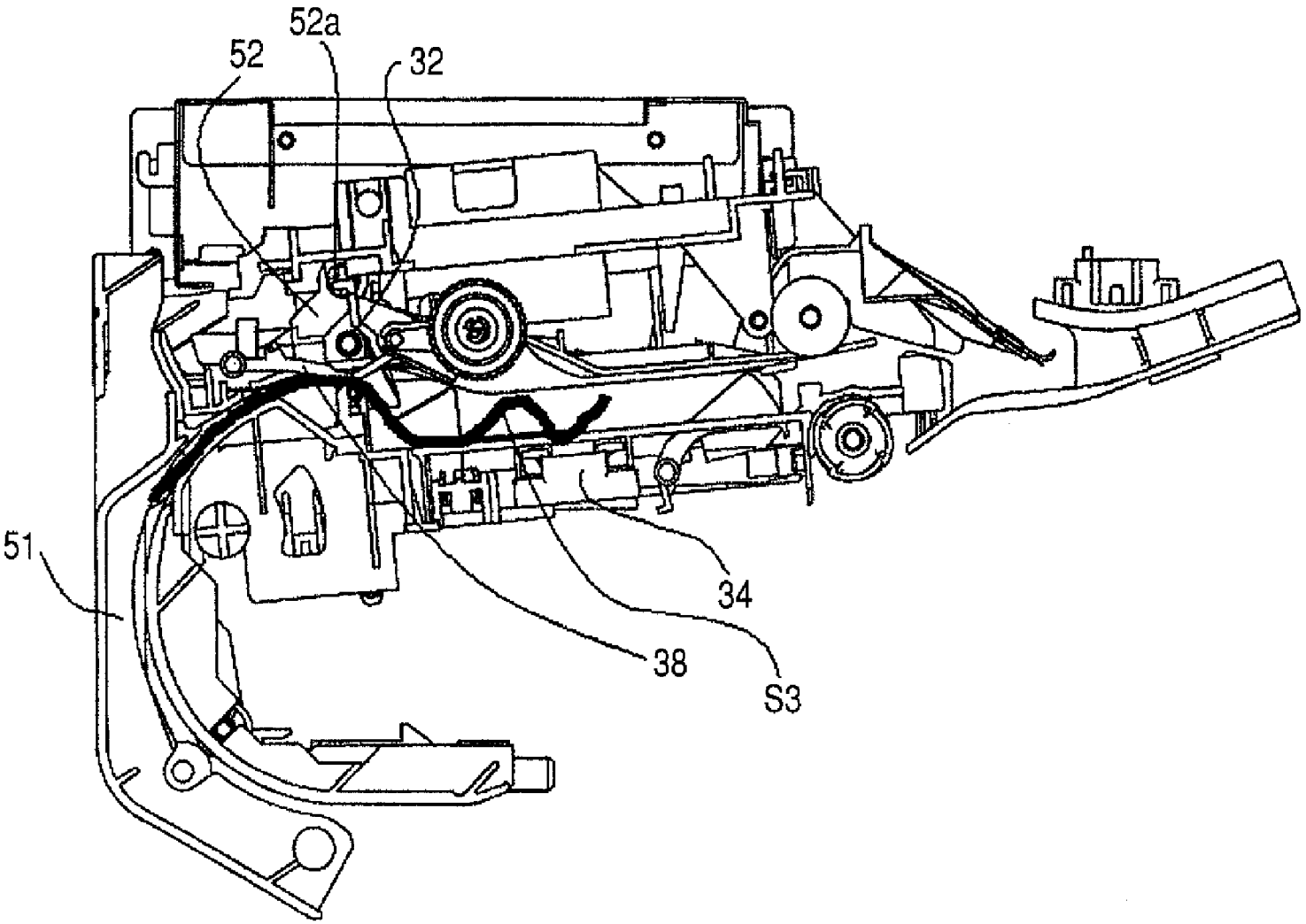
FIG. 8 is a first diagram of describing recovery at the time of a sheet jam in the above-described sheet processing apparatus.

As shown in FIG. 8, jam recovery at the time when a rear end of a jammed sheet S3 is in the upstream from the intermediate conveying roller 32 and a jam in a state that an end of the jammed sheet becomes in an accordion state in the downstream in the conveyance direction of the first presser member 38 is generated, will be described.

In this case, since access from an access direction 60 illustrated in FIG. 1 is hard, the jammed sheet S3 is drawn out from an access direction 61 to a direction reverse to the sheet conveyance direction.

Figure 9:
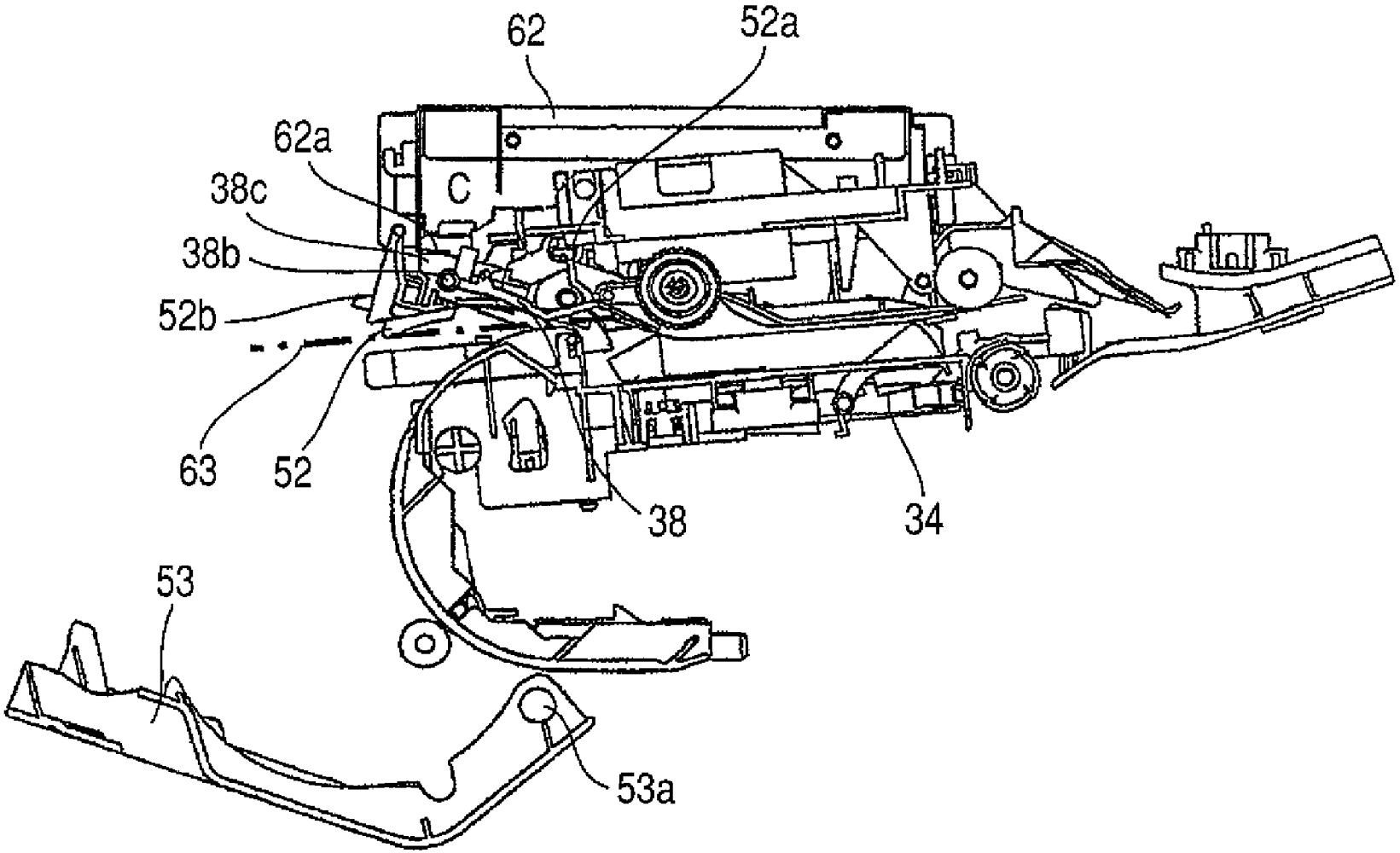
FIG. 9 is a second diagram of describing recovery at the time of a sheet jam in the above-described sheet processing apparatus.

For this reason, the jam recovery door 53 is opened by rotating the jam recovery door 53 downward with using the rotating shaft 53*a* as a fulcrum, first as illustrated in FIG. 9. Here, as illustrated in FIG. 9, the upper conveyance guide 52 has a cam surface 52*b*. Hence, when the jam recovery door 53 is closed, the upper conveyance guide 52 is forced down to a position, illustrated in FIG. 8, against the urge member not illustrated, owing to a cam surface which is provided in the jam recovery door 53, but which is not illustrated.

Thereby, when the jam recovery door 53 is opened, the pressure to the upper conveyance guide 52 by the cam surface of the jam recovery door 53 which is not illustrated is released. Hence, the upper conveyance guide 52 moves in a direction shown by an arrow C (upward) with using the rotating shaft 52*a* as a center. In addition, the upper conveyance guide 52 is constructed so that the cam surface 52*b* may be urged from the above by the cam surface of the jam recovery door 53, which is not illustrated, when the jam recovery door 53 is closed, and may return to the position in the conveying state illustrated in FIG. 8.

In addition, when the upper conveyance guide 52 moves in a direction shown by an arrow C (refer to FIG. 3) in this way, the rotating shaft 38*b* of the first presser member 38 installed in the upper conveyance guide 52 rises. Thereby, the cam surface 38*c* of the first presser member 38 abuts on an abutting portion 62*a* of the frame 62. In consequence, the first presser member 38 rotates upward with using the rotating shaft 38*b* as a fulcrum, and retracts upstream from the nip line 63 of the intermediate conveying roller 32 and the driven roller 32*b*.

That is, in this embodiment, the move portion which retracts the first presser member 38 from the sheet conveyance path R in a direction opposed to the opening direction of the cover member according to opening of the jam recovery door 53 includes the upper conveyance guide 52. Then, by constructing the move portion in this way, when the jam recovery door 53 is opened, the upper conveyance guide 52 moves to the position illustrated in FIG. 9. In connection with this, the first presser member 38 retracts upstream from the nip line 63 of the intermediate conveying roller 32 and the driven roller 32*b*.

Figure 10:
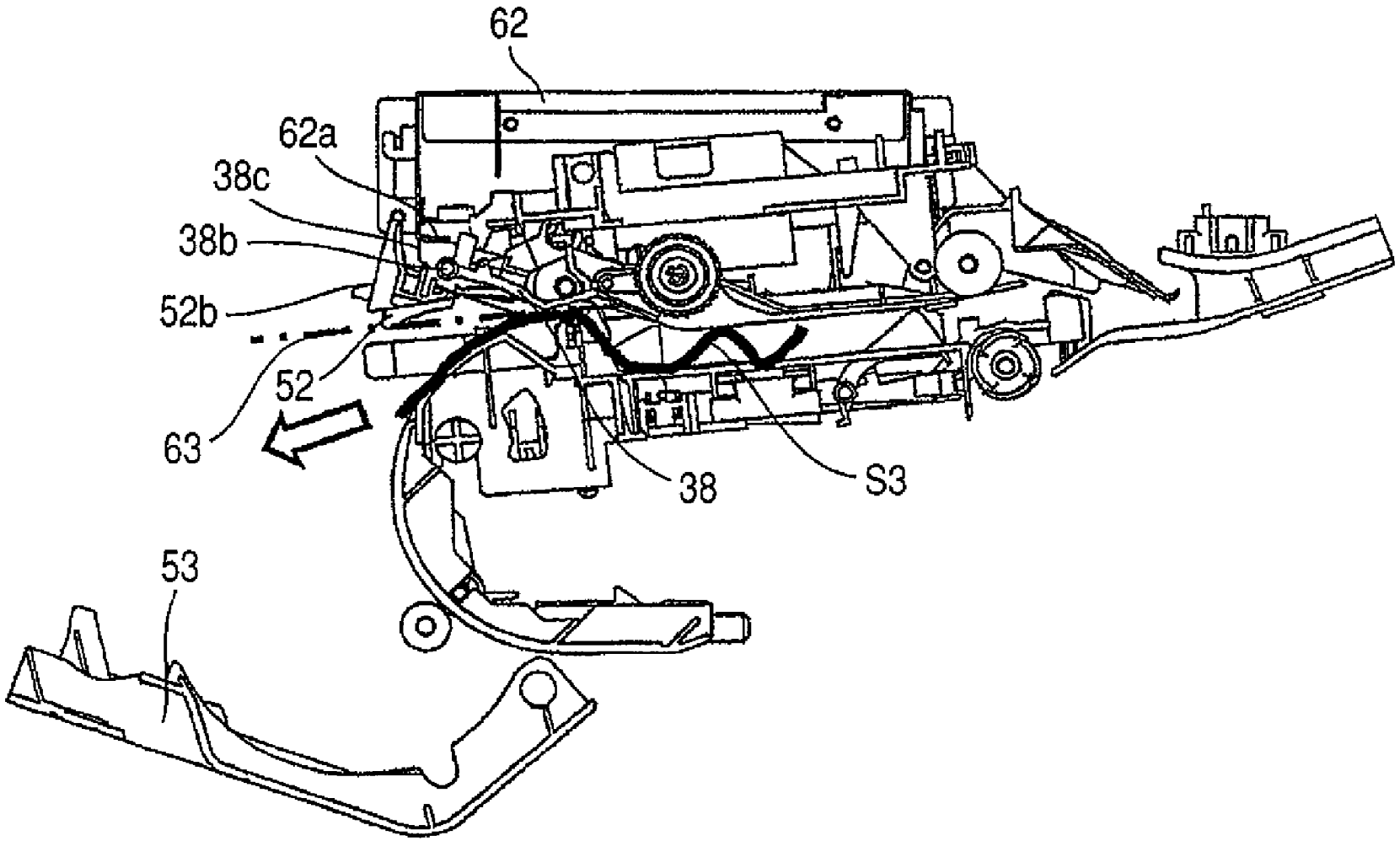
FIG. 10 is a third diagram of describing recovery at the time of a sheet jam in the above-described sheet processing apparatus.

Here, as shown in FIG. 8, the rear end portion of the jammed sheet S3 is located upstream from the intermediate conveying roller 32 in the conveyance direction. Hence, by moving the first presser member 38 in this way, as illustrated in FIG. 10, the jammed sheet S3 can be removed from the access direction 60 (refer to FIG. 1).

Figure 11:
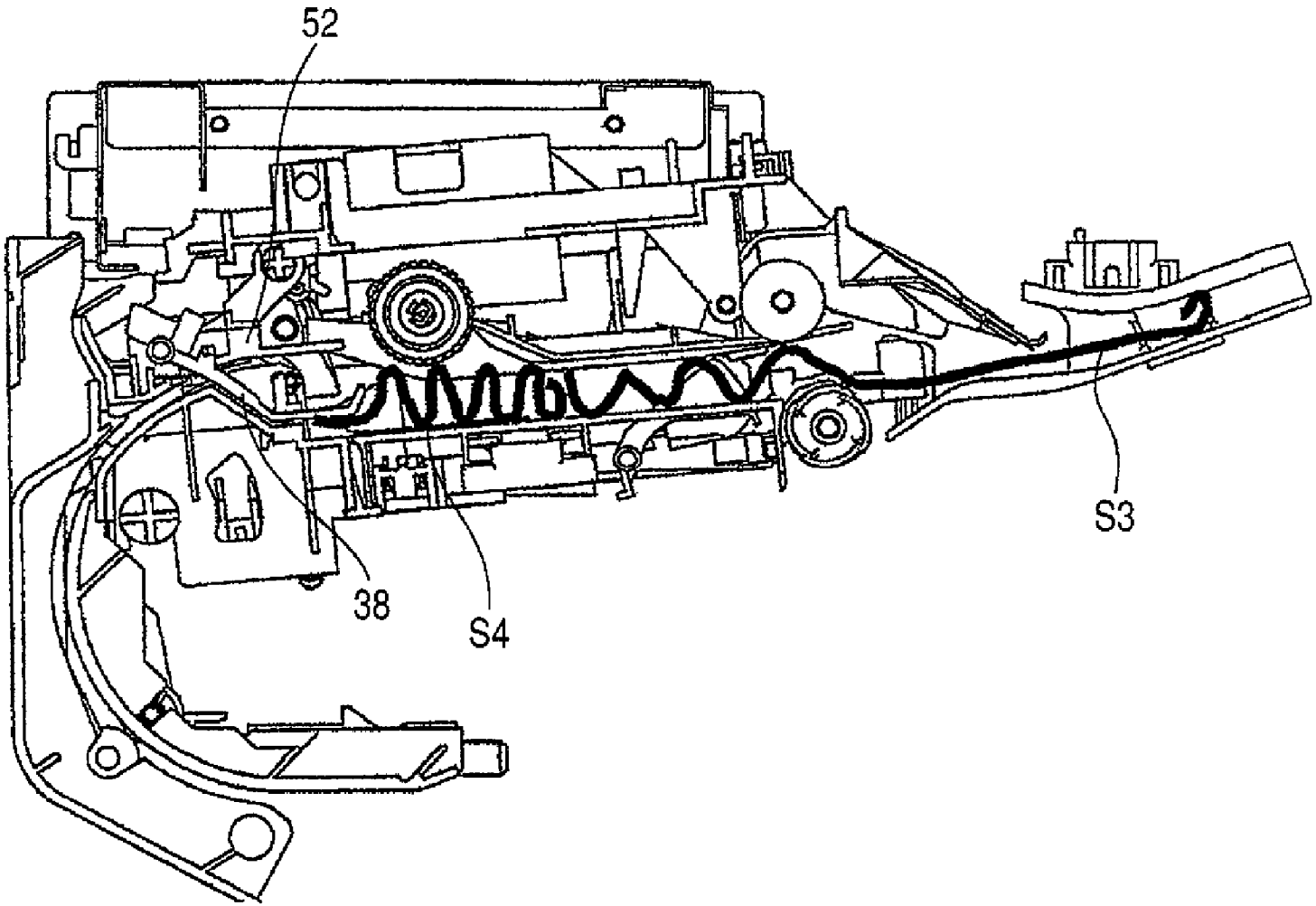
FIG. 11 is a first diagram of describing recovery at the time of a two-sheets jam in the above-described sheet processing apparatus.

Next, as illustrated in FIG. 11, jam recovery at the time of a state that an end of the second jammed sheet S4 is screened by the jammed sheet S3, which precedes, to cause a jam in an accordion state will be described. In addition, when a jam is caused in this way and a jam sensor as a jam detecting portion not illustrated detects this, conveyance of a sheet is stopped.

Then, when removing the jammed sheets S3 and S4 in the intermediate stack portion 34 in this state, access from both of the access direction 60 and the access direction 61 (refer to FIG. 1) illustrated in FIG. 1 is possible. However, jam recovery from the access direction 60 is poor in visibility because sheets are stacked on the sheet discharge tray 35 (refer to FIG. 1) and the image scanner 2 exists upward. In addition, since there are a lot of parts, such as the jogger 40, and a flag with full load detection which is not illustrated, access is hard.

Hence, although access from the access direction 60 is possible in regard to the jammed sheet S3 illustrated in FIG. 11, the access is extremely hard in regard to the jammed sheet S4. Then, in this embodiment, it is made to draw out the jammed sheet S4 from the access direction 61 after drawing out the jammed sheet S3 from the access direction 60.

Figure 12:
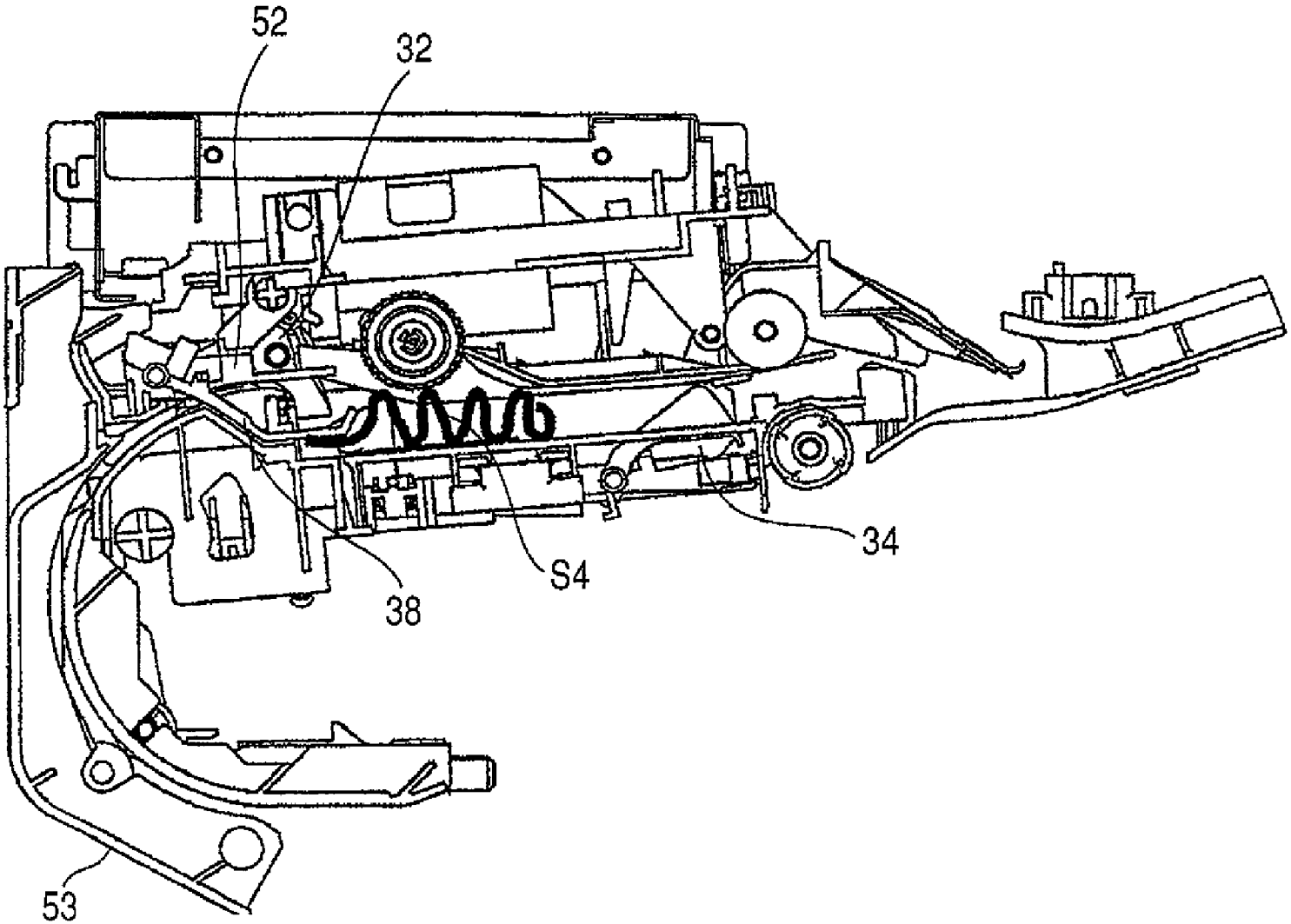
FIG. 12 is a second diagram of describing recovery at the time of a two-sheets jam in the above-described sheet processing apparatus.

Then, after drawing out the jammed sheet S3, in order to draw out the remaining jammed sheet S4 from the access direction 61 to a direction reverse to the sheet conveyance direction as illustrated in FIG. 12, first, the jam recovery door 53 is made to be opened. Then, by making the jam recovery door 53 opened, the first presser member 38 retracts upstream from the nip line of the intermediate conveying roller 32 and the driven roller 32*b*.

Here, even if the jam recovery door 53 is opened in this way, a rear end of the jammed sheet S4 is not in the upstream from the intermediate conveying roller 32 as shown in FIG. 12. Hence, the jammed sheet S4 cannot be drawn out as it is. Then, in this embodiment, as shown in FIG. 13, it is made that the lower conveyance guide 51 which is rotatable downward is pressed down as illustrated in an arrow with using the rotating shaft 51*a* as a fulcrum as described already.

Figure 13:
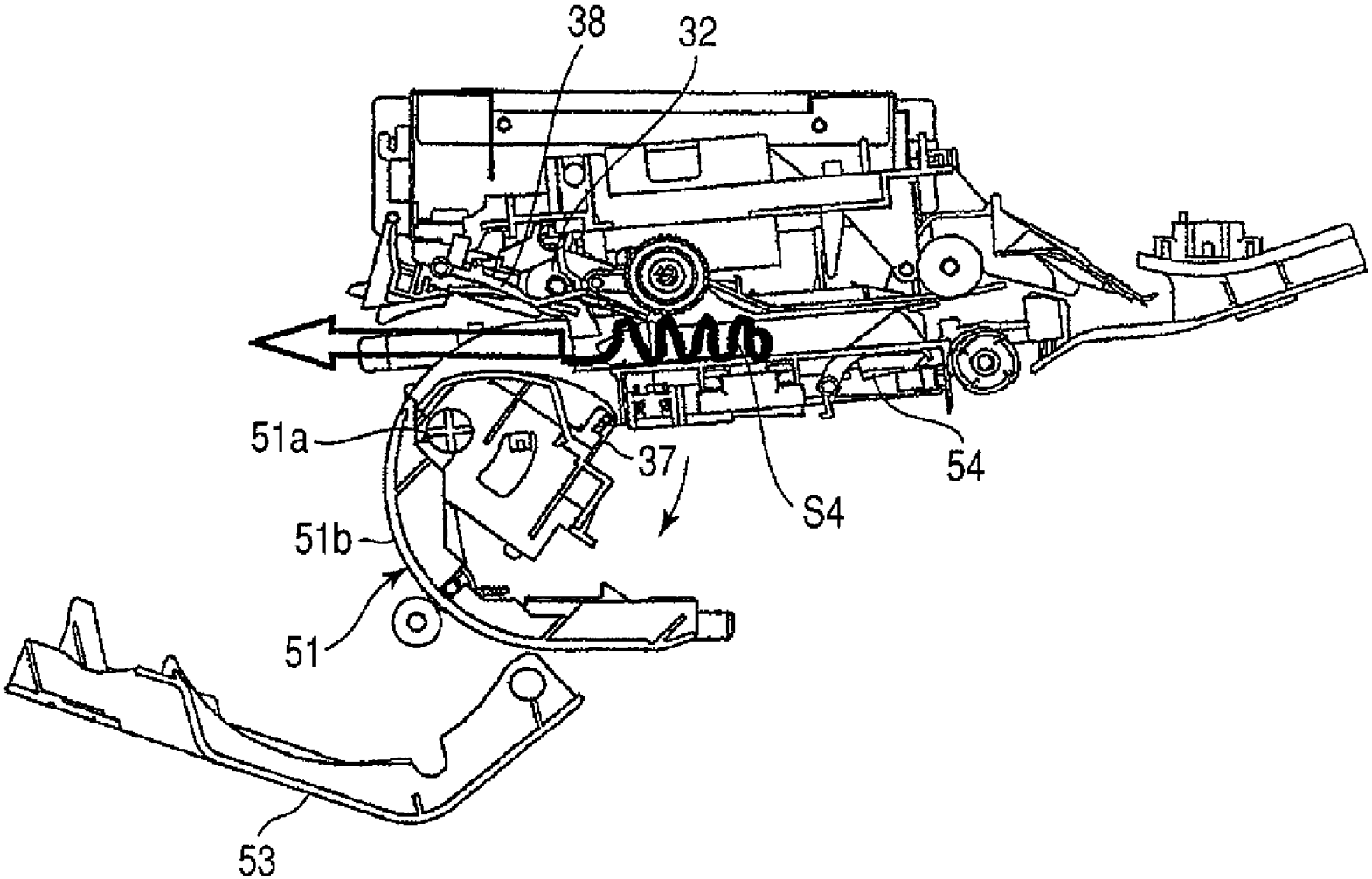
FIG. 13 is a third diagram of describing recovery at the time of a two-sheets jam in the above-described sheet processing apparatus.

Thereby, since the guide surface 51*b* of the lower conveyance guide 51, the reference wall 37, and the driven roller 32*b* (refer to FIG. 4) of the intermediate conveying roller drop below integrally, the driven roller 32*b* separates from the intermediate conveying roller 32 as shown in FIG. 13. In consequence, a user can access a position of the intermediate stack portion 34 from the access direction 61, and can draw out the jammed sheet S4.

In addition, since the first presser member 38 has retracted to an retracting position inside the apparatus at this time, a user does not touch the first presser member 38 at the time of jam recovery. Hence, damage of the first presser member 38 can be prevented. In addition, what can be also prevented are that the jammed sheet S4 is torn because an end of the first presser member 38 is caught by the jammed sheet S4, and that the first presser member 38 is damaged because the jammed sheet S4 entangles an end portion of the presser member 38.

In this way, when drawing out a jammed sheet from the sheet conveyance path R to a direction reverse to the sheet conveyance direction, the jammed sheet can be processed easily without damage by retracting the first presser member 38 from the sheet conveyance path R.

In consequence, occurrence of damage of the first presser member 38 at the time of jam recovery can be prevented without raising strength of the first presser member 38. In addition, a sheet residual in the intermediate stack portion by a jammed sheet being caught in the first presser member 38 and being torn can be prevented.

Thereby, jam recovery excellent in usability can be performed without damaging the first presser member 38 which securely restricts lifts of rear ends of the sheets stacked in the intermediate stack portion 34 so as to perform processing to the sheets in the sheet processing apparatus.

In addition, in this embodiment, since the second presser member 39 has comparatively larger strength than that of the first presser member 38, the construction that the second presser member 39 is retracted at the time of jam recovery is not taken. However, it is needless to say that retraction construction similar to that of the first presser member 38 may be also taken for the second presser member 39.

Furthermore, in this embodiment, the first presser member 38 and the second presser member 39 are rotatably provided, but not limited to this construction as a moving member. For example, the first presser member 38 and the second presser member 39 are slidable while being pressed by a sheet as a moving member.

Next, a second embodiment of the present invention will be described.

Figure 14:
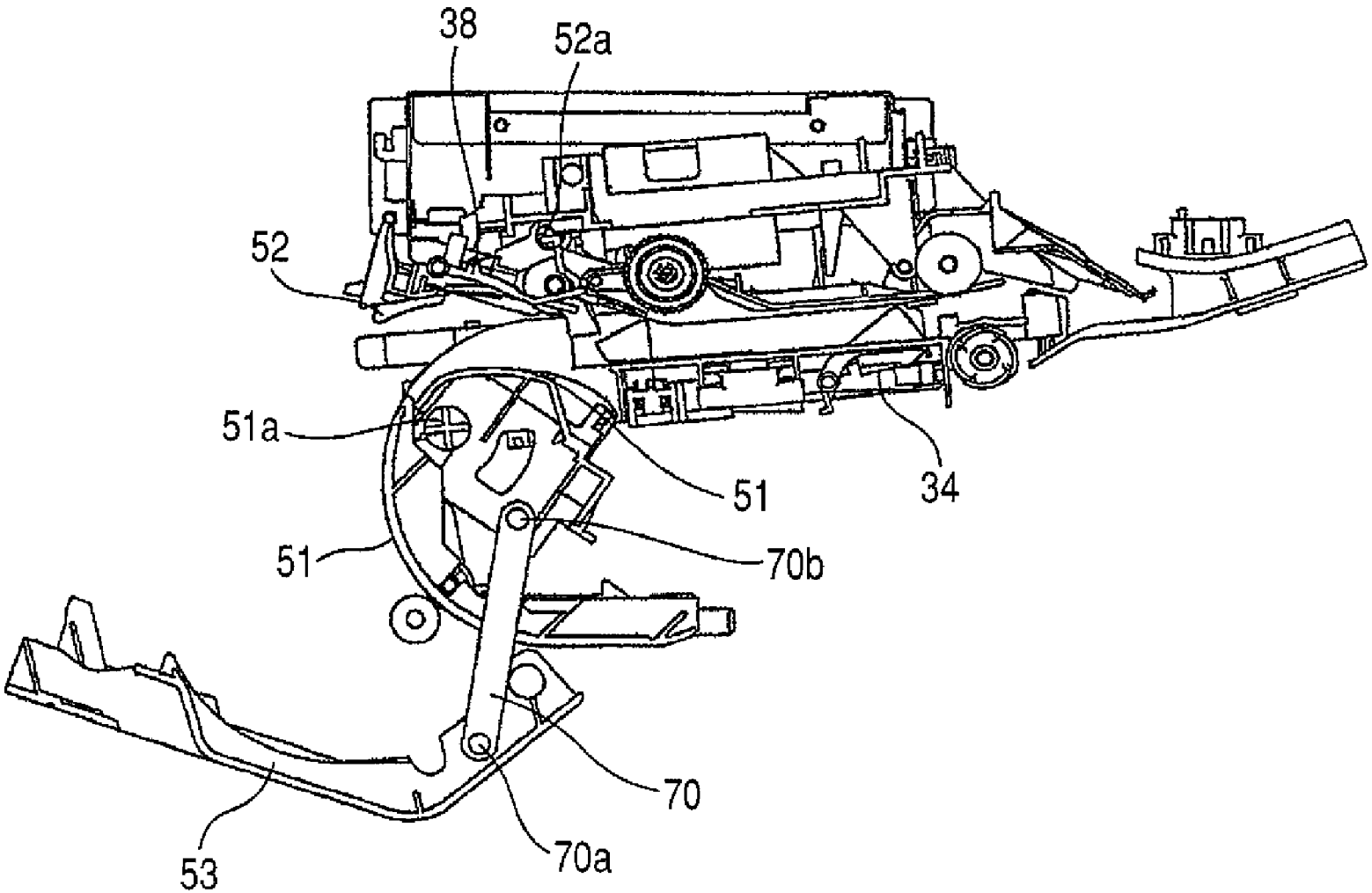
FIG. 14 is a diagram illustrating schematic construction of a sheet processing apparatus according to a second embodiment of the present invention.

FIG. 14 is a diagram illustrating construction of a sheet processing apparatus according to this embodiment. In addition, in FIG. 14, the same reference symbols as those in FIG. 9 described already denote the same or equivalent parts.

FIG. 14 illustrates a link lever 70 which is a link member which connects the lower conveyance guide 51 with the jam recovery door 53, a rotational fulcrum 70*a* which connects the jam recovery door 53 and the link lever 70, and a rotational fulcrum 70*b* which connects the lower conveyance guide 51 and the link lever 70.

In addition, FIG. 14 illustrates a state that the jam recovery door 53 is opened, and when the jam recovery door 53 is opened in this way, the lower conveyance guide 51 rotates in a direction that the driven roller 32*b* separates from the intermediate conveying roller 32 with using the rotating shaft 51*a* as a center by the link lever 70. Thus, in this embodiment, the lower conveyance guide 51 is rotated downward with interlocked with the opening of the jam recovery door 53.

Furthermore, when the jam recovery door 53 is closed after jam recovery is completed, the lower conveyance guide 51 is counterclockwise rotated with using the rotating shaft 51*a* as a center, and moves to a position, where the driven roller 32*b* press-contact with the intermediate conveying roller 32, to become conveyable as illustrated in FIG. 3.

Then, by rotating the lower conveyance guide 51 with interlocking with the opening of the jam recovery door 53 in this way, when the jam recovery door 53 is opened, it becomes unnecessary for a user to press down the lower conveyance guide 51.

Thereby, when the jam recovery door 53 is opened, nip of the intermediate conveying roller 32 and the driven roller 32*b* is always released. Hence, for example, also at the time of the jam recovery of the jammed sheet S3 as illustrated in FIG. 10, the jammed sheet S3 can be easily drawn out. In addition, since it is not necessary to apply a load on the intermediate conveying roller 32, tear of the jammed sheet S3 can be also prevented.

Next, a third embodiment of the present invention will be described.

Figure 15:
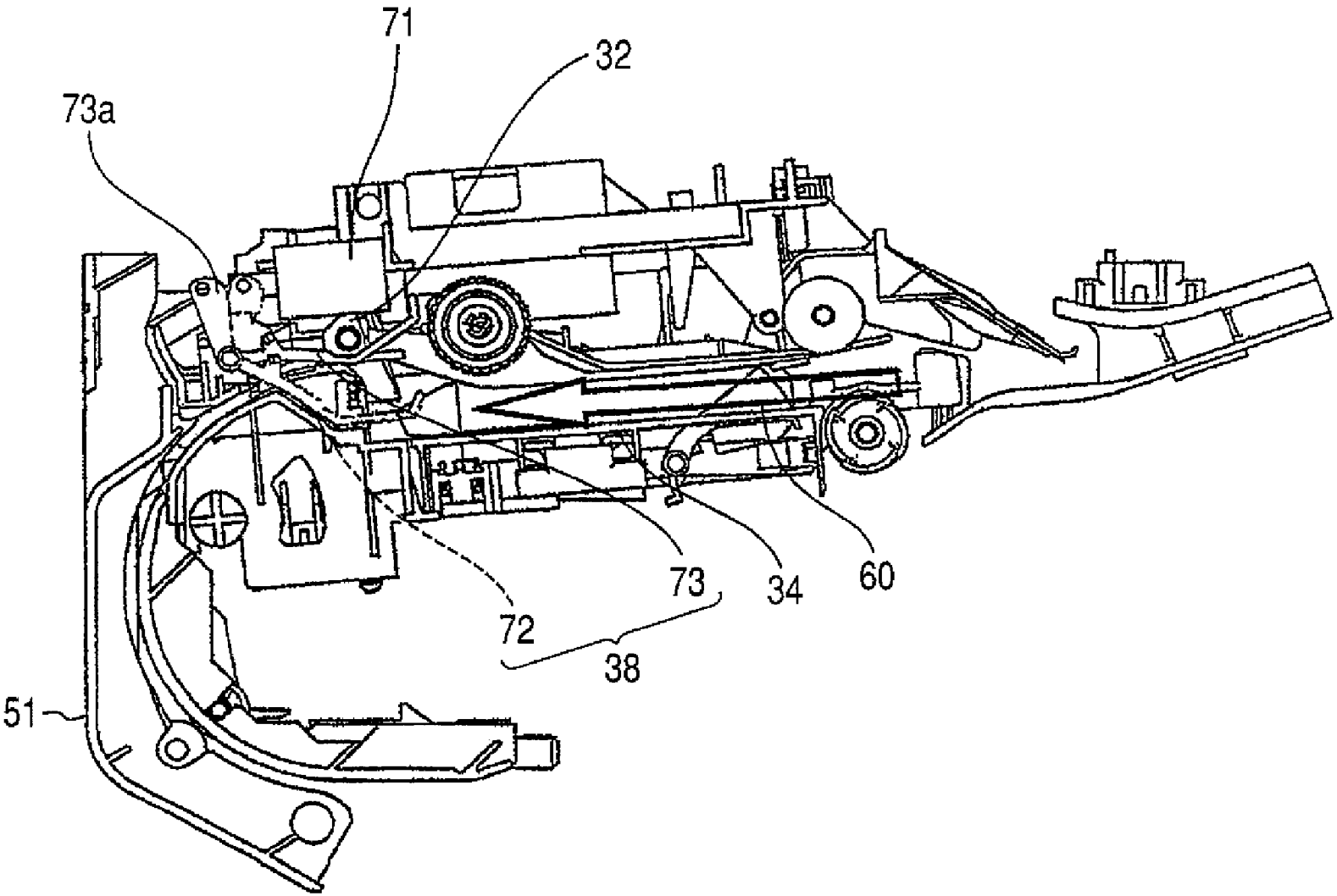
FIG. 15 is a diagram illustrating schematic construction of a sheet processing apparatus according to third and fourth embodiments of the present invention.
Figure 16:
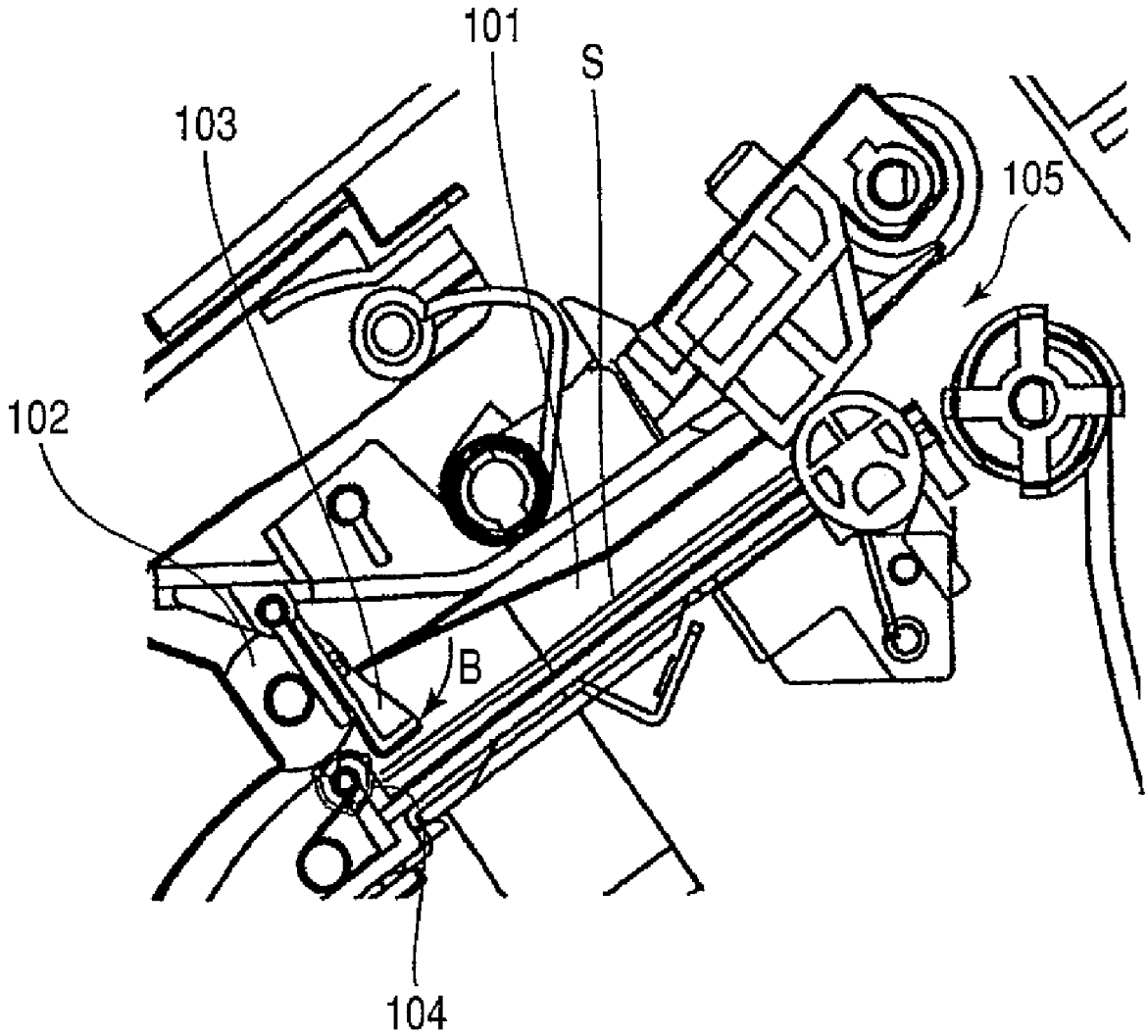
FIG. 16 is a diagram for describing construction of a conventional sheet processing apparatus.

FIG. 15 is a diagram illustrating construction of a sheet processing apparatus according to this embodiment. In addition, in FIG. 15, the same reference symbols as those in FIG. 8 described already denote the same or equivalent parts.

In FIG. 15, a solenoid 71 constructs a move portion for moving the first presser member 38 to a position denoted by reference numeral 72, or a position denoted by reference numeral 73. In addition, the position denoted by reference numeral 72 is a position (hereinafter, an abutting position) in which the first presser member 38 abuts on a sheet conveyed by the intermediate stack portion 34.

In addition, the position denoted by reference numeral 73 is an retracting position in which the first presser member 38 retracts so as not to abut on a jammed sheet, when the jammed sheet is drawn out from the sheet conveyance path R to a direction reverse to the sheet conveyance direction. A door switch as a detecting portion which detects the opening of the jam recovery door 53 is provided in the sheet processing apparatus according to this embodiment. Then, energization of the solenoid 71 is turned off with a detection signal which communicates the opening of the jam recovery door 53. In this way, when the first presser member 38 is moved to the retracting position inside the apparatus by the solenoid 71, and then, when the upper conveyance guide 52 is opened with the opening of the jam recovery door 53, a jammed sheet can be drawn out.

Here, the first presser member 38 is usually urged and held with a spring, not illustrated, in the retracting position. But, when the solenoid 71 is energized, the link section 73*a* is drawn, and, thereby, the first presser member 38 moves to the abutting position against the spring not illustrated. In addition, timing when the solenoid 71 is energized in this way is a duration from a rear end of a sheet passing through the intermediate conveying roller 32 to be stacked onto the intermediate stack portion 34, to before an end of a following sheet abutting on the first presser member 38 in the abutting position.

Next, a fourth embodiment of the present invention will be described using FIG. 15 similarly to the third embodiment described above.

In this embodiment, when the sensor not illustrated detects a jam of a sheet conveyed, a controller not illustrated turn off energization of the solenoid 71 in any case. Thereby, the first presser member 38 is constructed so as to move to the retracting position immediately by the spring not illustrated. In short, in this embodiment, it is made that, when occurrence of a jam is detected, the solenoid 71 moves the first presser member 38 to the retracting position. As the time of a sheet jam, when the solenoid 71 moves the first presser member 38 to the retracting position in this way, and then, when the jam recovery door 53 and the upper conveyance guide 52 are opened, a jammed sheet can be drawn out.

Thereby, after the jam occurs, for example, also in the case that a user performs an operation of removing a jammed sheet in the intermediate stack portion using a tool, such as a rod, from the access direction 60 (refer to FIG. 1), since the first presser member 38 has moved to the retracting position, the tool never touches the first presser member 38. In consequence, damage of the first presser member 38 can be prevented.

Here, it is not limited that electric power of this solenoid 71 is turned off in particular only when a jam occurs, but, this solenoid 71 shall be turned off in all the situations that a user can perform a jam recovery action, such as job completion and power shutdown of a body.

In addition, in the previous description, although the first presser member 38 (and second presser member) is cited as an example of a rotation member, the present invention is not limited to this. So long as it is a device that is rotatably provided in the sheet conveyance path R, and abuts on a sheet to pass, and rotates toward the sheet conveyance direction while being pressed by the sheet, the present invention is applicable also to a flag member of a sensor which detects transit of a sheet in the sheet conveyance path R, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2006-096437, filed Mar. 31, 2006, and No. 2007-061015, filed on Mar. 9, 2007 which are hereby incorporated by reference herein in their entirety.

What is claimed is:

1. A sheet conveyance apparatus which conveys a sheet, including:

a sheet conveyance path through which a sheet is conveyed to a sheet stack portion;

a pressing member which is movable by abutting a sheet passing, and which presses down sheets stacked on the sheet stack portion;

a move portion which retracts the pressing member from the sheet conveyance path; and a cover member which is openable to expose the sheet conveyance path in a opening direction, wherein the move portion moves the pressing member to a retracting position from the sheet conveyance path in a direction opposed to the opening direction of the cover member according to opening of the cover member.

2. A sheet conveyance apparatus according to claim 1, wherein the move portion includes an upper guide member, constructing the sheet conveyance path, which provides the pressing member movably and is movable to expose the sheet conveyance path, and moves the upper guide member in a direction of opening the sheet conveyance path according to opening of the cover member and moves the pressing member to the retracting position from the sheet conveyance path with movement of the upper guide member.

3. A sheet conveyance apparatus according to claim 1, further comprising:

an abutting section which abuts on the pressing member with movement of an upper guide member to move the pressing member in the retracting position.

4. A sheet conveyance apparatus according to claim 2, further including:

a sheet conveying roller pair which is provided in the sheet conveyance path; and a lower guide member which constructs the sheet conveyance path with the upper guide member, and provides one of the sheet conveying roller pair, wherein the lower guide member is movable so that one of the sheet conveying roller pair may separate from another with opening of the cover member.

5. A sheet conveyance apparatus according to claim 1, further including:

a link member which moves a lower guide member according to opening of the cover member.

6. A sheet conveyance apparatus according to claim 1, further comprising:

a detecting portion which detects an opening of the cover member, wherein the move portion moves the pressing member to a retracting position from the sheet conveyance path according to an opening detection signal of the detecting portion.

7. A sheet conveyance apparatus according to claim 1, wherein the cover member exposes said sheet conveyance path in the upstream from the pressing member in the sheet conveyance direction.

8. A sheet conveyance apparatus according to claim 1 wherein the cover member is at least a part of said sheet conveyance path with an upper guide member.

9. An image forming apparatus, including:

an image forming portion which forms an image; and the sheet conveyance apparatus according to claim 1 which conveys a sheet on which an image is formed by the image forming portion.

10. A sheet processing apparatus, including:

the sheet conveyance apparatus according to claim 1 which conveys a sheet to a sheet stack portion; and a sheet processing unit which performs processing to sheets stacked on the sheet stack portion.

11. An image forming apparatus, including:

an image forming portion which forms an image; and the sheet processing apparatus according to claim 10 which performs processing to a sheet on which an image is formed by the image forming portion.

12. An image forming apparatus, including:

an image forming portion which forms an image;

an image scanner which is arranged with keeping an interval above the image forming portion; and the sheet processing apparatus according to claim 10 which is arranged in a space formed between the image forming portion and the image scanner, and which performs processing to a sheet on which an image is formed by the image forming portion.

* * * * *